US006979224B2

(12) United States Patent
Boemmel et al.

(10) Patent No.: US 6,979,224 B2
(45) Date of Patent: Dec. 27, 2005

(54) CONNECTOR WITH RETENTION CLIPS FOR A RIBBON CABLE

(75) Inventors: Christian Otto Boemmel, Langen (DE); Rolf Jetter, Darmstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/759,816

(22) Filed: Jan. 16, 2004

(65) Prior Publication Data

US 2004/0166726 A1 Aug. 26, 2004

(30) Foreign Application Priority Data

Jan. 16, 2003 (EP) ..... 03000686

(51) Int. Cl.[7] ..... H01R 12/24
(52) U.S. Cl. ..... 439/492; 439/496
(58) Field of Search ..... 439/492, 493, 439/495, 496, 499

(56) References Cited

U.S. PATENT DOCUMENTS

| | | | | |
|---|---|---|---|---|
| 4,687,276 | A * | 8/1987 | Stockmaster | 439/557 |
| 4,749,371 | A | 6/1988 | Hirai et al. | 439/497 |
| 5,397,247 | A * | 3/1995 | Aoki et al. | 439/496 |
| 5,897,394 | A * | 4/1999 | Adachi | 439/496 |
| 6,010,359 | A * | 1/2000 | Etters et al. | 439/496 |
| 6,250,959 | B1 | 6/2001 | Yamaguchi et al. | 439/578 |
| 6,264,500 | B1 | 7/2001 | Kawabe | 439/496 |
| 6,280,217 | B1 * | 8/2001 | Lin | 439/260 |
| 6,352,442 | B1 * | 3/2002 | Kudo | 439/260 |
| 6,379,177 | B1 * | 4/2002 | Chang | 439/495 |
| 6,558,186 | B1 * | 5/2003 | LePottier et al. | 439/496 |
| 6,755,683 | B2 * | 6/2004 | Roberts et al. | 439/496 |
| 2003/0119353 | A1 * | 6/2003 | Hotea | 439/492 |

FOREIGN PATENT DOCUMENTS

| | | | |
|---|---|---|---|
| EP | 0 234 780 A1 | 9/1987 | H01R 13/193 |
| EP | 0 810 122 A2 | 12/1997 | B60R 16/02 |

* cited by examiner

*Primary Examiner*—Hae Moon Hyeon
(74) *Attorney, Agent, or Firm*—Barley Snyder LLC

(57) ABSTRACT

A connector for a ribbon cable includes a housing having a ribbon cable receiving region extending between a front surface and a back surface of the housing. A ribbon cable disposed in the ribbon cable receiving region. The ribbon cable has contact sections arranged at the back surface of the housing. Retention clips arranged on the back surface of the housing that receive a portion of the ribbon cable. The retention clips are arranged at a fixed spacing such that the contact sections of the ribbon cable are accessible between each of the retention clips for receiving contact elements.

25 Claims, 3 Drawing Sheets

CONNECTOR WITH RETENTION CLIPS FOR A RIBBON CABLE

FIELD OF THE INVENTION

The invention relates to a contact arrangement for a ribbon cable and, more particularly, to a connector for a ribbon cable.

BACKGROUND OF THE INVENTION

Ribbon cables are used in a wide range of technical fields, such as, motor vehicle engineering, because they are flexible and enable a plurality of wires to be installed in tight spaces. The ribbon cables are secured in connectors and are electrically connected to contact elements. Although conventional connectors used for this purpose are simple to manufacture, these conventional connectors are often formed such that access to the ribbon cable for contact by the contact elements is limited. Additionally, these conventional connectors afford very little support for the ribbon cable.

SUMMARY OF THE INVENTION

It is, therefore, an object of the invention to provide a connector for a ribbon cable where the ribbon cable is well supported and easily accessible.

This and other objects are achieved by a connector for a ribbon cable comprising a housing having a ribbon cable receiving region extending between a front surface and a back surface of the housing. Retention clips are arranged on the back surface of the housing and extend into the ribbon cable receiving region. The retention clips are arranged at a fixed spacing such that the ribbon cable receiving region is accessible between each of the retention clips for receiving contact elements.

This and other objects are further achieved by a connector comprising a housing having a ribbon cable receiving region extending between a front surface and a back surface of the housing. A ribbon cable disposed in the ribbon cable receiving region. The ribbon cable has contact sections arranged at the back surface of the housing. Retention clips arranged on the back surface of the housing that receive a portion of the ribbon cable. The retention clips are arranged at a fixed spacing such that the contact sections of the ribbon cable are accessible between each of the retention clips for receiving contact elements.

This and other objects are still further achieved by a connector arrangement comprising a contact socket having first and second contact elements. A connector has a ribbon cable receiving region extending between a front surface and a back surface of the housing. A ribbon cable disposed in the ribbon cable receiving region. The ribbon cable has contact sections formed on top and bottom surfaces thereof. Retention clips formed on the back surface of the housing receive a portion of the ribbon cable. The retention clips are arranged at a fixed spacing such that the contact sections are accessible between each of the retention clips by the first and second contact elements.

DETAILED DESCRIPTION OF THE INVENTION

Figure 1:
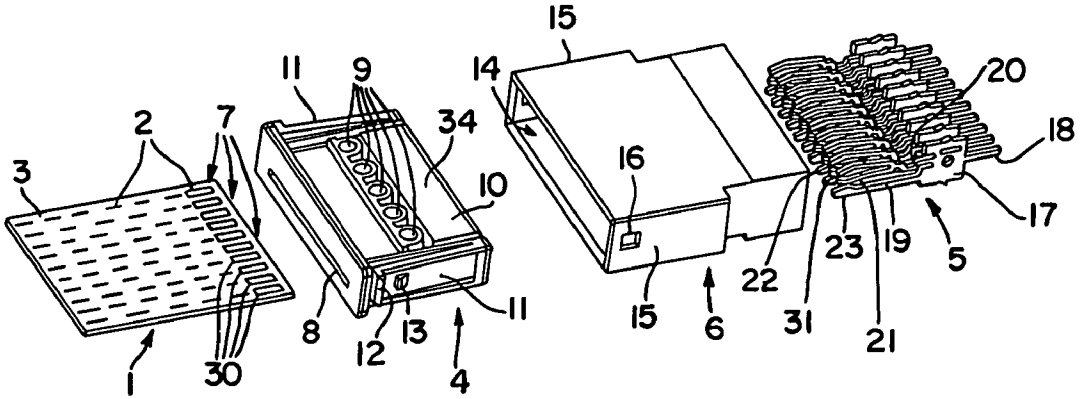
FIG. 1 is an exploded view of a contact arrangement showing a ribbon cable, connector, contact socket, and contact element.
Figure 2:
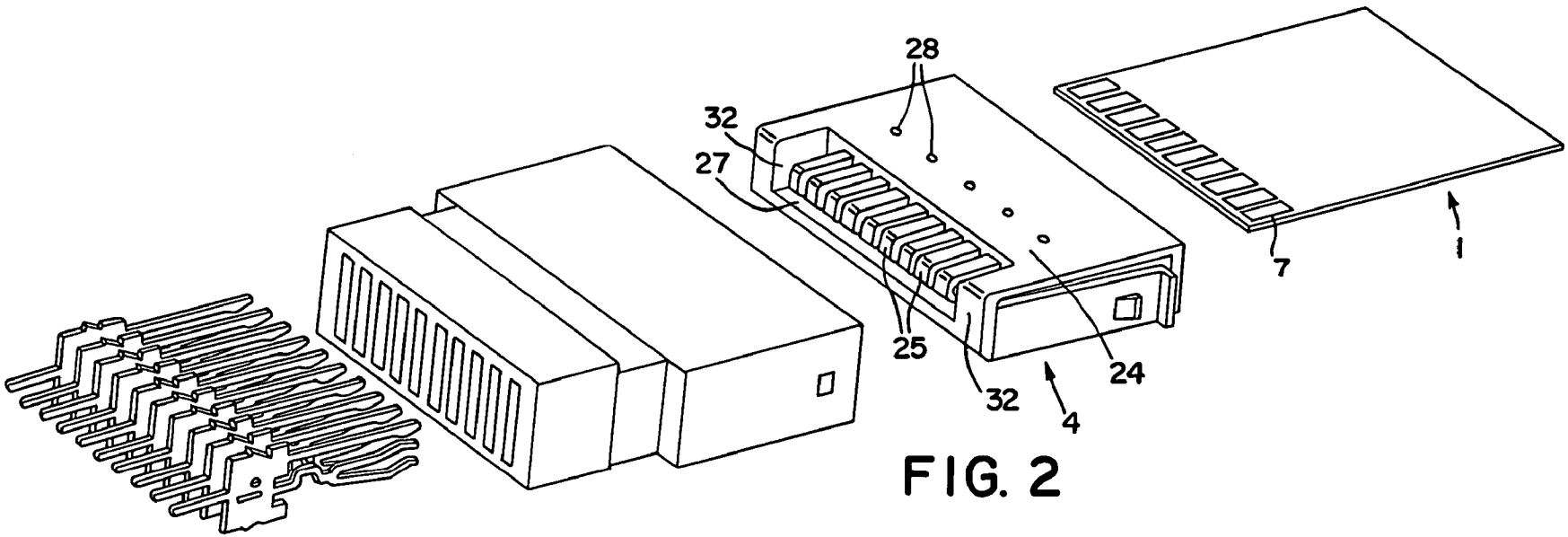
FIG. 2 is an exploded view of a bottom side of the contact arrangement of FIG. 1.

FIGS. 1 and 2 show a contact arrangement including a ribbon cable 1, a connector 4, a contact socket 6, and a contact element 5. FIGS. 1 and 2 show the individual parts of the contact arrangement before assembly and before insertion of the connector 4 into the contact socket 6.

As shown in FIG. 1, the ribbon cable 1 includes a plurality of conductor wires 2 arranged in parallel. The conductor wires 2 are surrounded by an insulation layer 3 and are illustrated diagrammatically by dashed lines inside the insulation layer 3. As shown in FIGS. 1 and 2, contact windows 7 are provided on top and bottom surfaces of the ribbon cable 1 and adjacent to the conductor wires 2. The insulation layer 3 is stripped-off of the conductor wires 2 in a region adjacent to the contact windows 7 to form an exposed contact section 30. Alternatively, if insulation displacement contact elements (not shown), which penetrate the insulation layer 3 to establish contact with the conductor wires 2, are used in the contact arrangement, the ribbon cable 1 may be formed without the contact windows 7 and the insulation layer 3 does not have to be stripped-off of the conductor wires 2.

As shown in FIG. 1, the contact socket 6 has a substantially rectangular insertion aperture 14 for receiving the connector 4. The insertion aperture 14 has a cross-section that substantially corresponds to a cross-section of the connector 4 so that the connector 4 is guided by inner surfaces of the contact socket 6 when inserted therein. Retention recesses 16 are formed on opposing side walls 15 of the contact socket 6 near the insertion aperture 14. Opposite the insertion aperture 14, a rear surface of the contact socket 6 has an opening for receiving the contact element 5.

Figure 5:
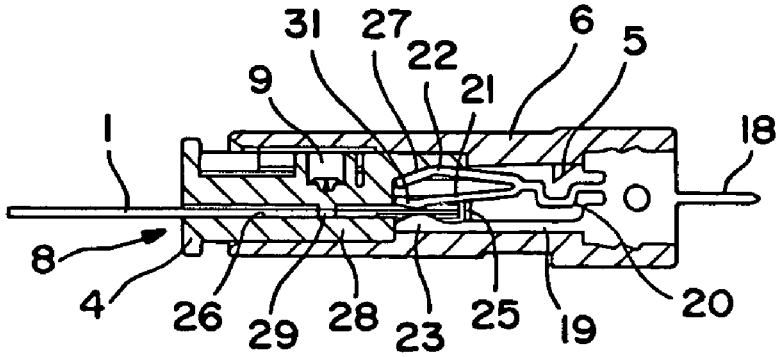
FIG. 5 is a cross-sectional view of the contact arrangement in an assembled state.

As shown in FIG. 1, the contact element 5 includes a contact plate 17. The contact plate 17 has connecting pins 18 molded on a back surface of the contact plate 17 and first and second contact elements 19, 20, respectively, molded on a front surface of the contact plate 17 opposite to the connecting pins 18. Each of the first contact elements 19 has a convex contact region 23. As best shown in FIG. 5, each of the second contact elements 20 branches into third and fourth contact elements 21, 22, respectively. The third and fourth contact elements 21, 22 are arranged in a common plane with the first contact element 19. The third and fourth contact elements 21, 22 are arranged to form a substantially oval shape and have ends that extend beyond the convex contact region 23 of the first contact element 19. The third contact element 21 has a convex contact region 31 arched towards the convex contact region 23 of the first contact element 19. The convex contact region 31 of the third contact element 21 is arranged at a fixed distance above the convex contact region 23 of the first contact element 19.

Figure 3:
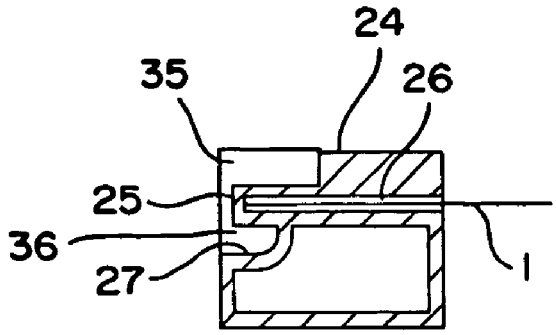
FIG. 3 is a cross-sectional view of the connector of FIG. 2.
Figure 4:
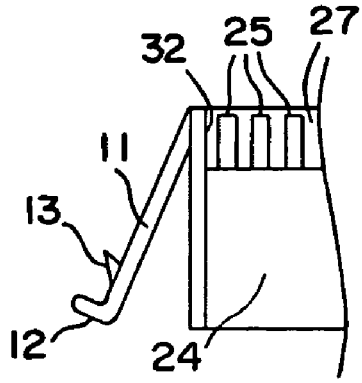
FIG. 4 is a partial perspective view of a support arm of the connector.

As shown in FIGS. 1 and 5, the connector 4 consists of a housing 10 having an insertion slot 8 on a rear surface thereof for insertion of the ribbon cable 1. Adjacent to the insertion slot 8 is a ribbon cable receiving region 26 that extends to a front surface or contact side of the connector 4. Retention holes 9 are formed on an upper surface 34 of the housing 10. Support elements 11 extend along longitudinal side walls 32 of the housing 10. The support elements 11 are formed from a flexible material, such as plastic, and have a first end molded onto the housing 10 on the contact side of the connector 4. Each of the support elements 11 is preferably identical in shape. As best shown in FIG. 4, each of the support elements 11 is arranged at a fixed angle relative to the longitudinal side walls 32 of the housing 10. The support elements 11 extend to the rear surface of the connector 4 and have a lever 12 on an exterior side thereof that extends outwards. A cam 13 is provided on the exterior side of each of the support elements 11 near the lever 12. The cams 13 are formed to correspond with the retention recesses 16 on the contact socket 6 so that the support elements 11 positively secure the connector 4 to the contact socket 6 when the connector 4 is received therein. As shown in FIG. 3, the housing 10 has an actuation surface 27 preferably arranged at a sloping angle toward an insertion direction of the connector 4.

As shown in FIG. 2, a lower surface 24 of the housing 10 has secondary retention holes 28 opposite the retention holes 9. The lower surface 24 merges on the contact side of the housing 10 into the retention clips 25 that may be molded with the housing 10. Each of the retention clips 25 have the same width and are arranged between the longitudinal side walls 32 of the housing 10 at a fixed spacing from one another and within the receiving region 26. The retention clips 25 are preferably formed such that the retention clips 25 do not extend beyond the longitudinal side walls 32 of the housing 10 so that the retention clips 25 are protected from being damaged. The retention clips 25 are arranged at a fixed distance from the upper surface 34 of the housing 10 so that the spaces between the retention clips 25 are easily accessible by the first and third contact elements 19, 21 from the upper and lower surfaces 34, 24 of the housing 10.

As shown in FIG. 5, each of the retention clips 25 is substantially u-shaped and has a first side 36 that forms a contact surface for the ribbon cable 1 and a second side 35 that is longer than the first side 36 that forms a bearing and retention surface for the ribbon cable 1. As shown in FIG. 3, the second sides 35 of the retention clips 25 and an exposed part of the receiving region 26 are freely accessible for contact with the first contact element 19 from the lower surface 24 of the housing 10, and the first sides 36 of the retention clips 25 are arranged at a fixed distance below the actuation surface 27 of the housing 10 so that an exposed part of the receiving region 26 and the first sides 36 are freely accessible for contact with the third contact element 21 from the upper surface 34 of the housing 10.

As shown in FIG. 5, the connector 4 has retaining pins 29. The retaining pins 29 are formed to extend from the retention holes 9 to the secondary retention holes 28. The retaining pins 29 may be made, for example, from plastic.

Assembly of the contact arrangement will now be described in greater detail. As shown in FIG. 3, the ribbon cable 1 is inserted into the insertion slot 8, receiving region 26, and retention clips 25 of the connector 4 until the edge of the ribbon cable 1 is received between the first sides 36 and second sides 35 of the retention clips 25. As shown in FIG. 5, the ribbon cable 8 is secured in the connector 4 by the retention pins 29, which are inserted into the retention holes 9, through the ribbon cable 1 into spaces between the conductor wires 2, and through the secondary retention holes 28. The retention pins 29 are connected to the housing 10 of the connector 4 and may be crimped, soldered, or glued thereto. The ribbon cable 1 is thereby fixed parallel and perpendicular to the direction of insertion.

As shown in FIG. 5, the contact element 5 is arranged in the contact socket 6 and is positioned to electrically contact the conductor wires 2 of the ribbon cable 1 when the contact arrangement is assembled. The contact element 5 is inserted into a side of the contact socket 6 opposite the insertion aperture 14 until the contact elements 19, 21, 22 are arranged between the retention clips 25. The connector 4 is inserted into the insertion aperture 14 of the contact socket 6 until the exposed contact sections 30 of the conductor wires 2 are arranged between the convex contact regions 23, 31 of the first and third contact elements 19, 21. The first contact element 19 is arranged beneath the ribbon cable 1, and the third and fourth contact elements 21, 22 are arranged above the ribbon cable 1. As a result, relatively large contact elements 19, 21 can be used to contact the conductor wire 1, and the retention clips 25 can aid in aligning the contact elements 19, 21 with the conductor wires 2 of the ribbon cable 1.

As the connector 4 is inserted into the contact socket 6, the fourth contact element 22 is biased via the actuation surface 27 towards the ribbon cable 1. Because the actuation surface 27 is arranged at a sloping angle towards the insertion direction of the connector 4, the distance between the actuation surface 27 and the ribbon cable 1 decreases towards a center of the connector 4. The fourth contact element 22, therefore, is pressed towards the ribbon cable 1 when the connector 4 is inserted into the contact socket 6. Since the fourth contact element 22 is connected to the third contact element 21, the third contact element 21 is also pressed toward the ribbon cable 1 and into contact therewith. As a result, pressure is exerted onto the exposed contact sections 30 of the conductor wires 2 by the convex contact region 31 of the third contact element 21 from above and the convex contact region 23 of the first contact element 19 from below when the connector 4 is inserted. In this way the conductor wire 2 of the ribbon cable 1 can be contacted on both sides, and a high contact force can be achieved without damaging the conductor wires 2.

Alternatively, a flat actuation surface may be used to bias the first, third, and fourth contact elements 19, 21, 22. In this instance, the fourth contact element 22 is constructed to extend upwards from a free end thereof, so that the flat actuation surface forces the third contact element 21 further toward the ribbon cable 1 with increasing insertion depth of the connector 4.

Figure 6:
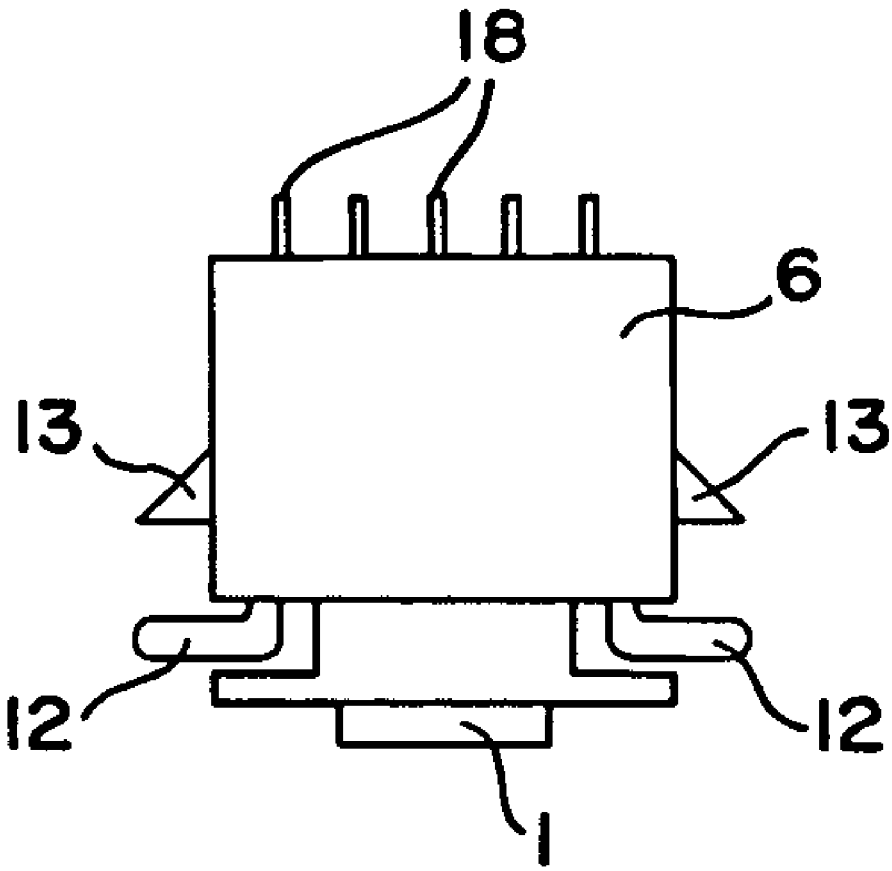
FIG. 6 is a plan view of a top side of the contact arrangement of FIG. 5.

As shown in FIG. 6, as the connector 4 is received in the contact socket 6, the cams 13 are received in the retention holes 16 and the support elements 11 are tightened by the longitudinal side walls 32 of the housing 10 towards the side walls 15 of the connector 4. To remove the connector 4 from the contact socket 6, the support elements 11 are pressed inward by the levers 12, and the cams 13 are led inward and out of the retention holes 16 so that the connector 4 may be removed from the contact socket 6.

We claim:

1. A connector for a ribbon cable, comprising:

a housing having a ribbon cable receiving region extending between a front surface and a back surface of the housing; and substantially u-shaped retention clips arranged on the back surface of the housing that extend into the ribbon cable receiving region, the retention clips being arranged at a fixed spacing such that spaces are formed between the retention clips for receiving contact elements, the retention clips being molded in a single piece with the housing.

2. The connector according to claim 1, wherein the retention clips have a first side that forms a contact surface for the ribbon cable and a second side that forms a bearing and retention surface for the ribbon cable.

3. The connector according to claim 1, wherein the retention clips are arranged parallel to each other.

4. The connector according to claim 1, wherein the housing has an actuation surface that extends adjacent to the ribbon cable receiving region for biasing the contact elements toward the ribbon cable receiving region.

5. The connector according to claim 1, wherein the housing has longitudinal side walls that extend between the front surface and the back surface, at least one of the longitudinal side walls having an elastic support element with a cam for positively locking the connector to a contact socket.

6. The connector according to claim 1, further comprising retaining pins for retaining the ribbon cable in the housing.

7. The connector according to claim 6, wherein the retaining pins extend between an upper surface and lower surface of the housing.

8. The connector according to claim 7, wherein the retaining pins are fixed to the housing.

9. A connector, comprising:

a housing having a ribbon cable receiving region extending between a front surface and a back surface of the housing;

a ribbon cable disposed in the ribbon cable receiving region and having contact sections arranged at the back surface of the housing; and substantially u-shaped retention clips arranged on the back surface of the housing that receive a portion of the ribbon cable, the retention clips being arranged at a fixed spacing such that spaces are formed between the retention clips for receiving contact elements, the spaces exposing the contact sections of the ribbon cable for contact with the contact elements.

10. The connector according to claim 9, wherein the retention clips are arranged parallel to each other.

11. The connector according to claim 10, wherein the retention clips have a first side that forms a contact surface for the ribbon cable and a second side that forms a bearing and retention surface for the ribbon cable.

12. The connector according to claim 9, wherein the housing has an actuation surface that extends adjacent to the contact sections for biasing the contact elements toward the contact sections.

13. The connector according to claim 9, wherein the housing has longitudinal side walls that extend between the front surface and the back surface, at least one of the longitudinal side walls having an elastic support element with a cam for positively locking the connector to a contact socket.

14. The connector according to claim 9, further comprising retaining pins for retaining the ribbon cable in the housing.

15. The connector according to claim 14, wherein the retaining pins extend between an upper surface and lower surface of the housing.

16. The connector according to claim 15, wherein the retaining pins are fixed to the housing.

17. The connector according to claim 9, wherein the contact sections are formed on top and bottom surfaces of the ribbon cable.

18. The connector according to claim 9, wherein the retention clips are molded to the housing.

19. A connector arrangement, comprising:

a contact socket having first and second contact elements;

a connector having a ribbon cable receiving region extending between a front surface and a back surface thereof, the connector being receivable in the contact socket;

a ribbon cable disposed in the ribbon cable receiving region, the ribbon cable having contact sections formed on top and bottom surfaces thereof; and substantially u-shaped retention clips formed on the back surface of the connector that receive a portion of the ribbon cable, the retention clips being arranged ay a fixed spacing such that spaces are formed between the retention clips that expose the contact sections, the first and second contact elements being receivable in the spaces, the retention clips being molded in a single piece with the connector.

20. The connector arrangement according to claim 19, wherein the retention clips are arranged parallel to each other.

21. The connector arrangement according to claim 19, wherein the housing has an actuation surface for biasing the second contact element toward the respective contact sections.

22. The connector arrangement according to claim 21, wherein the second contact element includes third and fourth contact elements that essentially form an oval shape.

23. The connector arrangement according to claim 19, wherein the housing has longitudinal side walls that extend between the front surface and the back surface, at least one of the longitudinal side walls having an elastic support element with a cam for positively locking the connector to the contact socket.

24. The connector arrangement according to claim 19, further comprising retaining pins for retaining the ribbon cable in the housing.

25. The connector arrangement according to claim 24, wherein the retaining pins extend between an upper surface and lower surface of the housing.

* * * * *